US007690643B2

(12) United States Patent
Imai

(10) Patent No.: US 7,690,643 B2
(45) Date of Patent: Apr. 6, 2010

(54) SHEET FEEDING APPARATUS AND IMAGE FORMING APPARATUS

(75) Inventor: Yusuke Imai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 11/681,880

(22) Filed: Mar. 5, 2007

(65) Prior Publication Data

US 2007/0273083 A1 Nov. 29, 2007

(30) Foreign Application Priority Data

Apr. 3, 2006 (JP) ..... 2006-102192

(51) Int. Cl.
*B65H 1/18* (2006.01)

(52) U.S. Cl. ..... 271/152; 271/154; 271/155

(58) Field of Classification Search ..... 271/147, 271/152, 153, 154, 155, 156, 157; 399/9, 399/16, 23
See application file for complete search history.

(56) References Cited

U.S. PATENT DOCUMENTS 6,137,968 A * 10/2000 Sunou et al. ..... 399/23
6,603,952 B2 * 8/2003 Hoene et al. ..... 399/393
2005/0006199 A1 * 1/2005 Brugger et al. ..... 194/347
2005/0051946 A1 * 3/2005 Otaki ..... 271/147
2006/0245768 A1 * 11/2006 Takeda et al. ..... 399/16
2007/0003356 A1 * 1/2007 Ferguson ..... 400/693
2007/0058990 A1 * 3/2007 Weaver et al. ..... 399/9

FOREIGN PATENT DOCUMENTS

JP 2003-246470 9/2003

OTHER PUBLICATIONS

U.S. Appl. No. 11/833,349, filed Aug. 3, 2007, T. Itabashi, et al.
U.S. Appl. No. 11/833,357, filed Aug. 3, 2007, A. Murakami, et al.

* cited by examiner

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

There is provided an apparatus provided with a tray which goes up and down with sheet stack being supported, a pickup roller which feeds the sheet on the tray a first detecting sensor which detects a object placed on the tray other than the sheets to be fed by the pickup roller, as the tray goes up.

10 Claims, 13 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and particularly to a sheet feeding apparatus and Invention The present invention relates an image forming apparatus equipped with a large capacity sheet accommodating portion and a tray which can control lifting and lowering.

2. Description of the Related Art

In recent years, image forming apparatuses such as copying machines and printers equipped with a large capacity sheet accommodating portion capable of replenishing to one tray a large quantity of sheets as many as several thousands of sheets have been increasing. Such large capacity accommodation portion is frequently equipped with a tray which is capable of lifting and lowering by driving from the sheet accommodating portion body.

With the sheet accommodating portion equipped with the tray, when sheet stacks are replenished on the tray and the sheet accommodating portion is set to the main body, the tray then goes up. When an uppermost surface of the sheet stack is detected by a paper surface position detecting unit, tray stopping control is executed. By this operation, the uppermost surface of the sheet stack becomes as the feeding position.

In many cases, such sheet accommodating portion meets with a plurality of sheet sizes. In this case, when sheets smaller than the maximum size capable of being accommodated in the sheet accommodating portion are replenished, a space free from sheet stack is generated on the tray It frequently occurs that a paper bag for spare sheets or a surplus sheet stack (hereafter referred to as foreign object) is left on this empty space. When the tray goes up while a foreign object is being placed on the tray, this foreign object may result in damage of the sheet accommodating portion apparatus.

This will be described referring to FIG. 9. FIG. 9 is a drawing for describing a problem due to the foreign object based on conventional configuration. For example, with a tray 61 as illustrated in FIG. 9A, a paper surface position detecting unit (not shown) for detecting upper surface of a sheet stack 50 being set on the tray 61 is usually provided. When upper surface of the sheet stack is detected by the paper surface position detecting unit, lifting of the tray 61 stops.

With this configuration, when a foreign object 90 is placed on the tray 61 and height of the foreign object 90 is higher than that of the sheet stack 50, as illustrated in FIG. 9A, the foreign object collides with uppermost part of an apparatus body 60 before the uppermost surface of the sheet stack 50 is detected by the paper surface position detecting unit.

This occurs similarly when, as illustrated in FIG. 9B, height of the foreign object 90 on the tray 61 is lower than that of the sheet stack 50. In other words, as the sheet is being fed, the tray 61 goes up by as much as lowering of upper surface position of the sheet stack 50. With this state, if upper surface position of the sheet stack 50 becomes lower than upper surface position of the foreign object 90, the foreign object 90 will collide with the uppermost part of the apparatus body 60.

In view of such problems, there is an apparatus which detects a foreign object on a tray, as described by, for example, Japanese Patent Application Laid-Open No. 2003-246470.

According to this proposal, holes are provided to a plurality of locations on the tray capable of lifting and lowering, and sensors are disposed respectively so as to cause a contact to protrude from these holes, when the tray is located at the lowest limit. With this configuration, when an object is placed so as to cover holes on the tray, the object can be detected by the contacts protruded from each of holes. When an object is detected by sensors provided at the position where a sheet is not to be originally placed, it can be determined that a foreign object exists.

However, with above-mentioned unit, in order to detect a foreign object on a sheet, the tray should be lowered to the lowest limit of lifting and lowering range whenever sheets are replenished. Therefore, when sheets are consumed thoroughly, the tray is lowered down to the lowest limit, it takes longer time before the tray is lowered completely, and the user have to wait during this period of time.

Further, according to the composition for detection of a foreign object, which is described by Japanese Patent Application Laid-Open No. 2003-246470, area of the tray covered by sheets replenished depends on the size of sheets. Therefore, a setting as to that touching of which sensor flag is determined to be foreign object should be made differently for every sheet size. In addition, if sheet size is set erroneously, it is probable that even a normal sheet is detected as a foreign object.

SUMMARY OF THE INVENTION

An object of the present invention is to recognize surely presence of a foreign object without impairing operability of the user in handling a large capacity tray.

In order to achieve the above object, the present invention includes:

a sheet feeding apparatus having:

a tray which lifts and lowers with sheet stack being supported, a sheet feeding member which feeds the sheet on the tray; and a first detecting unit which can detect, as the tray goes up, an object placed on the tray other than the sheets to be fed by the sheet feeding member.

DESCRIPTION OF THE PREFERRED EMBODIMENT

Now referring to drawings, embodiment for carrying out the present invention will be described hereafter in detail.

Figure 1:
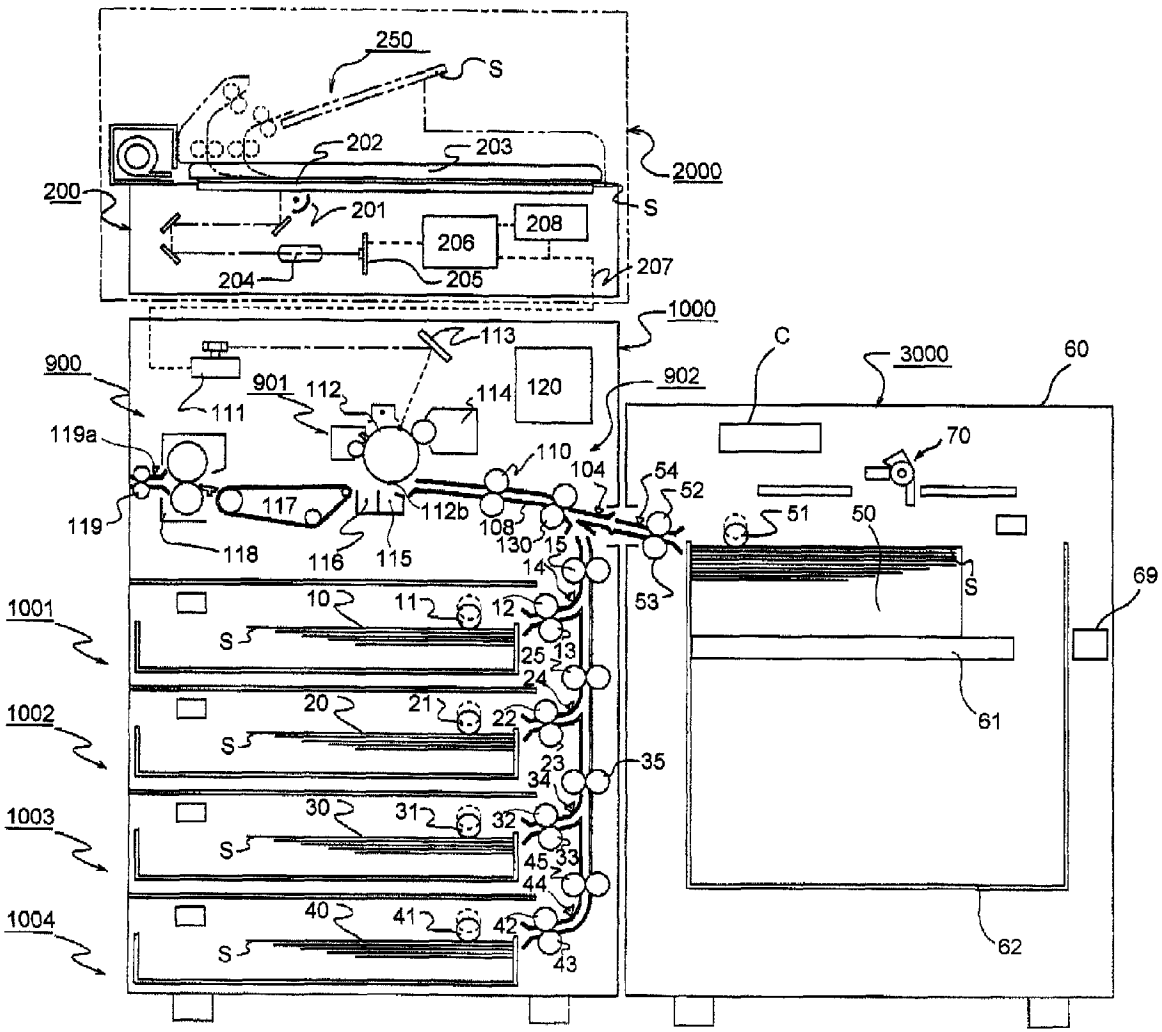
FIG. 1 is a cross sectional view of the image forming apparatus having the sheet feeding apparatus.

Meanwhile, in the embodiment shown below, description is given by exemplifying an image reading apparatus in an image forming apparatus such as copying machine . FIG. 1 is a cross sectional view of the image forming apparatus having the sheet feeding apparatus. In this embodiment, a printer is exemplified to represent an image forming apparatus.

(Outline of Image Forming Apparatus and Sheet Feeding Apparatus)

As illustrated in FIG. 1, a printer 1000 is exemplified as the image forming apparatus. The printer 1000 includes a printer body 900 and a scanner 2000 disposed on the upper surface of the printer body 900. Further, a paper deck 3000, to which a large capacity sheet accommodating portion 62 is set detachably attachable, is mounted to the printer body 900.

A scanner 2000 for reading an original includes a scanning optical system light source 201, a platen glass 202, an opening/closing original holding plate 203, a lens 204, a light receiving element (photoelectric conversion) 205, an image processing portion 206, a memory portion 208 for storing an image processing signal being processed by the image processing portion 206, and so on.

When the original is read, a light is irradiated by the scanning optical system light source 201 on the original (not shown) placed on the platen glass 202. An original image thus read is processed by the image processing portion 206 and then converted to an electrical signal 207 which is being encoded electrically. Following this, it is transmitted to a laser scanner 111 which serves as the image generating unit. Meanwhile, it is also possible to once store an image information processed and encoded by the image processing portion 206 in the memory portion 208 and to transmit the information to the laser scanner 111, as necessary, by a signal from a controller 120 which will be described later.

The printer body 900 includes sheet feeding apparatuses 1001 to 1004 for feeding sheet S, a sheet conveyance apparatus 902 for conveying the sheet S fed by the sheet feeding apparatuses 1001 to 1004 to an image forming portion 901, the controller 120 for controlling the printer 1000.

Here, the sheet feeding apparatuses 1001 to 1004, and the sheet feeding apparatus provided to the paper deck 3000 have nearly similar configurations and feed the sheet to the image forming portion 901 in similar manner.

The sheet feeding apparatuses 1001, 1002, 1003, 1004 include a separation portion comprising cassettes 10, 20, 30, 40, pickup rollers 11, 21, 31, 41, feed rollers 12, 22, 32, 42, and retard rollers 13, 23, 33, 43. With this composition, the sheets S in the cassette 10 are separated and fed one by one by the pickup rollers 11, 21, 31, 41 which lift/lower and rotate according to a predetermined timing, and the separation portion. Further, feeder sensors 14, 24, 34, 44 are provided in the vicinity of downstream side in sheet conveyance direction of the feed rollers 12, 22, 32, 42, and retard rollers 13, 23, 33, 43. Passing of the sheet S is detected by the feeder sensors 14, 24, 34, 44. The sheet conveyance apparatus 902 has, in addition to each of conveyance roller pairs 15, 25, 35, 45, a registration front roller pair 130 and a registration roller pair 110, and forms a registration roller portion. The sheet S fed by each of sheet feeding apparatuses 1001 to 1004 is passed through a sheet conveyance path 108 including a guide plate and is then introduced to the registration roller pair 110, by the registration front roller pair 13. Further, following this, the sheet S is conveyed to the image forming portion 901 by the registration roller pair 110.

Meanwhile, as the feeding unit, a pickup roller 51, a feed roller 52 and a retard roller 53 are disposed at the paper deck 3000. Each of rollers of the feeding unit is driven by a paper feeder driving unit Df (shown in FIG. 6). Besides, a feeder sensor 54 is disposed. A sensor 104 for detecting connection or passing of the sheet is disposed at connection part of the paper deck 3000 of the sheet conveyance apparatus 902.

The paper deck 3000 includes a sheet accommodating portion 62 configured to be capable of being drawn with regard to the apparatus body 60 of the paper deck 3000, the tray 61 for supporting the sheet stack 50, and a lifting and lowering driving unit Dt (shown in FIG. 6) for lifting and lowering of the tray 61. Further, paper feeding controls of the paper feeding unit of the paper deck 300 and lifting and lowering controls of the tray are controlled by a control unit C (shown in FIG. 6). The paper deck 3000 will be described later.

The image forming portion 901 includes a photosensitive drum 112, a laser scanner 111, a developing device 114, a transfer charger 115, separation charger 116. At image forming, a laser light from the laser scanner 111 is reflected by a mirror 113 and irradiated to exposure position on the photosensitive drum which is turning clockwise, thereby forming a latent image on the photosensitive drum. After that, toner is supplied from the developing device 114, and the latent image formed on the photosensitive drum 112 then becomes remarkable as the toner image.

The toner image on the photosensitive drum 112 is then transferred on the sheet S at the transfer portion by the transfer charger 115. Further, the sheet S on which the toner image is transferred is electrostatically separated from the photosensitive drum 112 by the separation charger 116, and is conveyed to a fixing device 118 by the conveyance belt 117. Here, fixing of the toner image is carried out with regard to the sheet S, which is then discharged outside the apparatus by a discharge roller 119. Further, a discharge sensor 119*a* is provided in the conveyance path between the fixing device 118 and discharge roller 119. Passing of the sheet S being discharged can be detected by the discharge sensor 119*a*.

Although, in the present embodiment, the printer body 900 and the scanner 2000 are arranged separately, the present invention is not limited thereto. For example, there is an image forming apparatus, in which the printer body 900 and the scanner 2000 are integrated to form one structure. Further the printer body 900 and the scanner 200 may be separated or integrally formed, which functions as a copying machine by inputting to the laser scanner 111 a processing signal of the scanner 2000. Meanwhile, when a facsimile transmission signal is input, it functions as a facsimile. Further, when an output signal of a personal computer is input, it functions as a printer. Contrary, when a processing signal of the image processing portion 206 of the scanner 2000 is transmitted to other facsimile, it functions as a facsimile. Further, in the scanner 2000, if an automatic original feeding apparatus 250, which is shown by chain double-dashed line, is mounted in place of the original holding plate 203, the original can be read automatically.

Figure 2A:
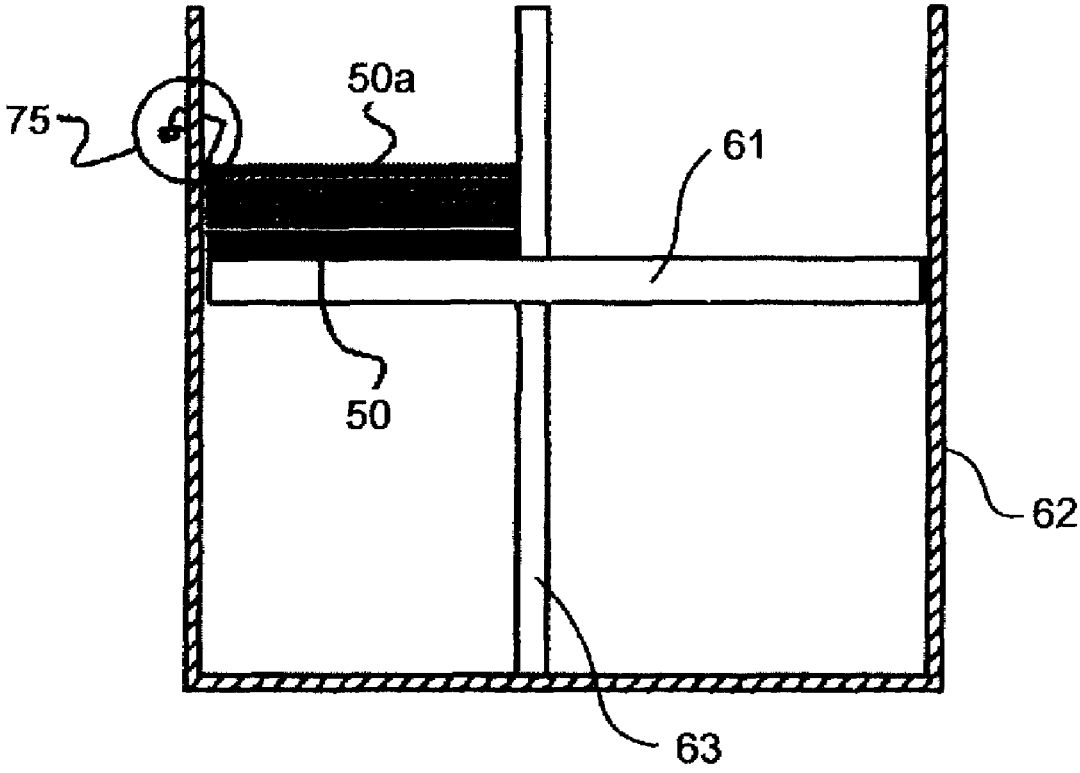
FIGS. 2A and 2B are cross sectional views illustrating the sheet feeding apparatus in a state without foreign object.
Figure 2B:
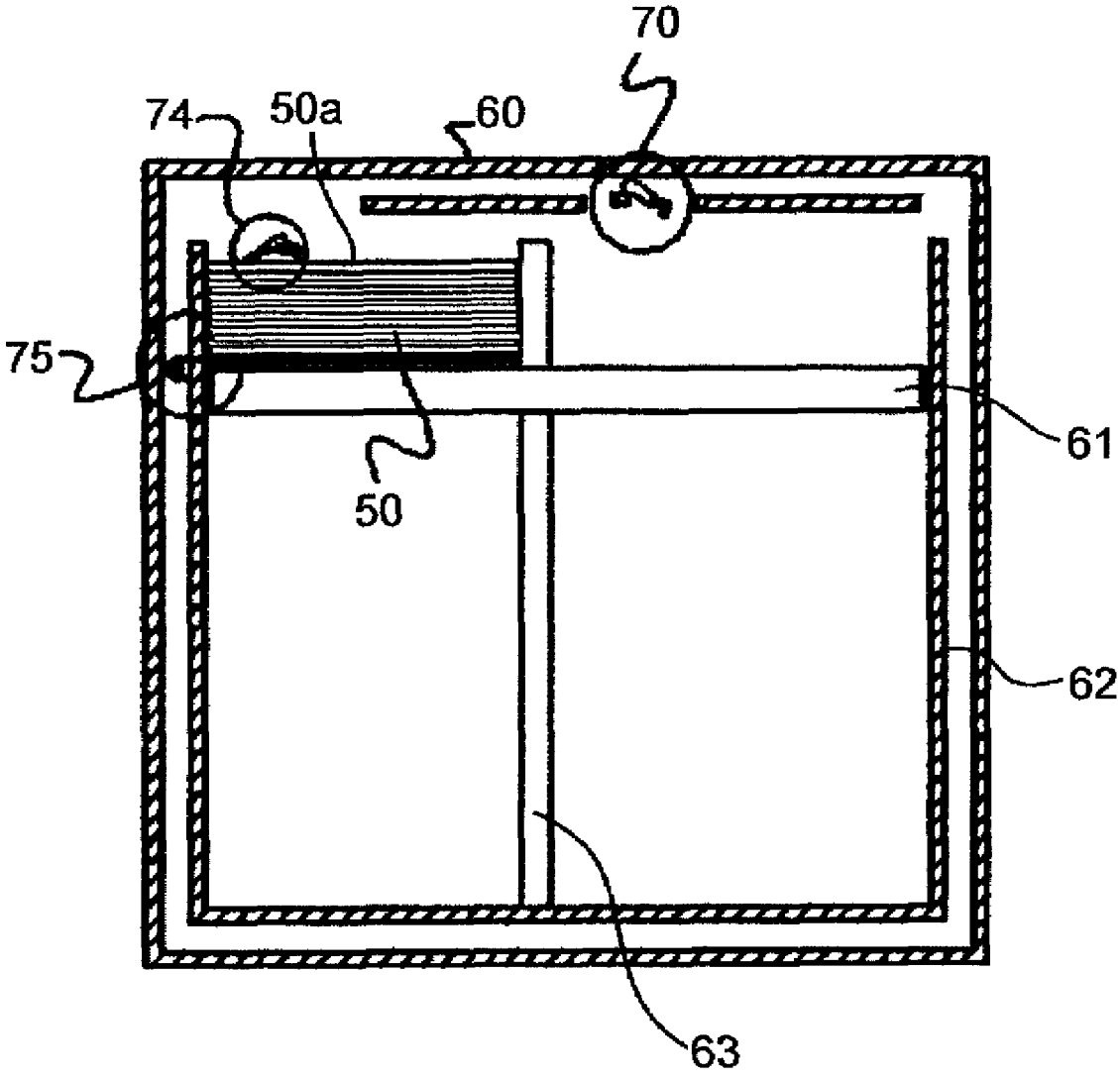
Figure 3A:
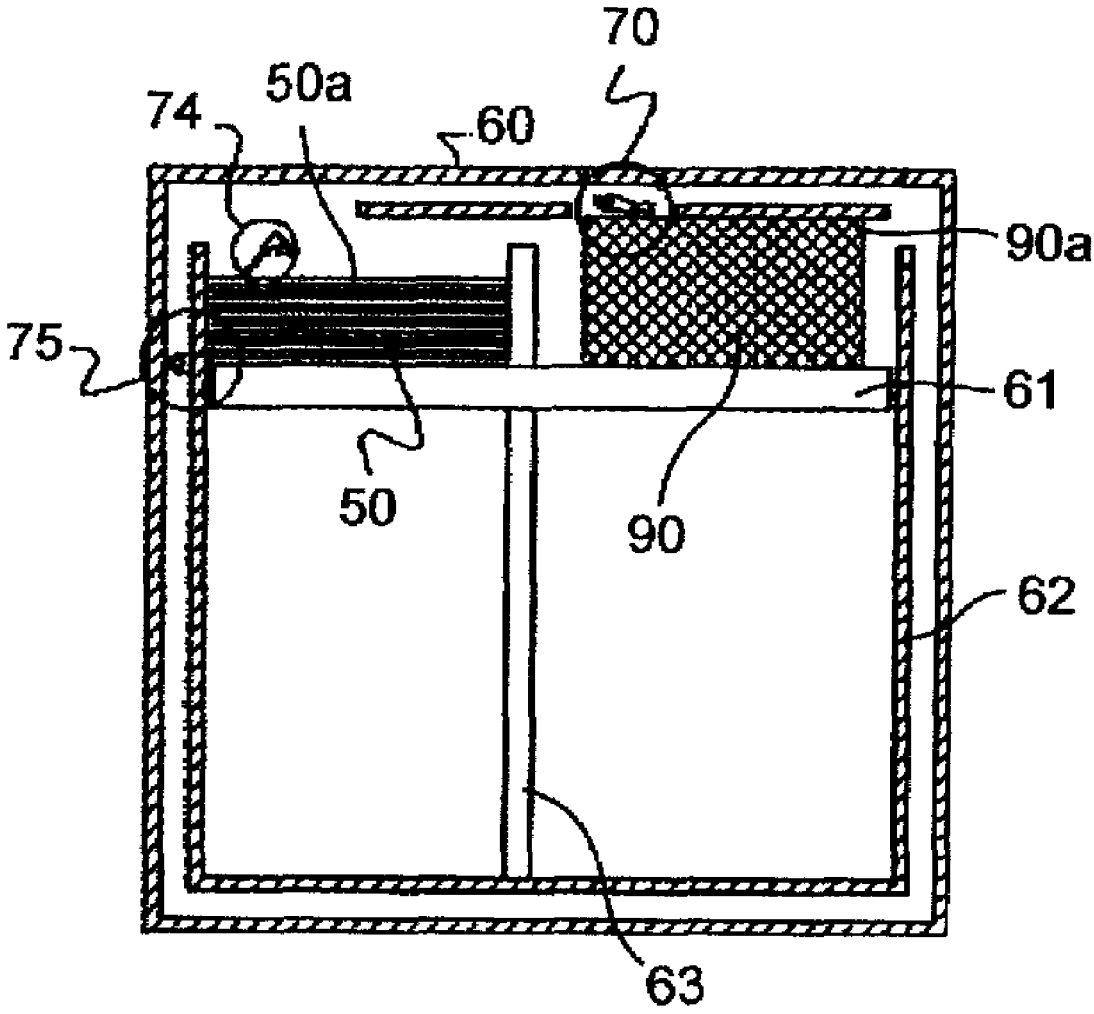
FIG. 3A to 3C are cross sectional views illustrating the sheet feeding apparatus in a state with foreign object.

The apparatus according to the present embodiment has a detecting unit for detecting the position of tray 61 and a foreign object detection unit, with regard to the paper deck 3000 shown in FIG. 1. This will be described in detail later. FIGS. 2A and 2B are cross sectional views illustrating the sheet feeding apparatus in a state without foreign object, and FIG. 3 is a cross sectional view illustrating the sheet feeding apparatus in a state with foreign object. Further, FIG. 4 is a side elevation view describing details of a third detecting sensor 75.

(Detection of Position of Tray 61 or Sheet Stack 50)

FIG. 2A illustrates a configuration of the sheet accommodating portion 62, and FIG. 2B illustrates a composition in such a state where the sheet accommodating portion 62 is accommodated in the apparatus body 60 of the paper deck 3000. The sheet accommodating portion 62 is provided to be capable of being drawn with regard to the apparatus body 60, and a lock mechanism 69 (shown in FIG. 1) for locking the sheet accommodating portion 62 is provided to ensure that withdrawal during sheet feeding operation is not possible. Numeral 63 is a sheet rear end regulating plate 63 for aligning the end of the sheet stack 50.

As illustrated in FIGS. 2A and 2B, as the sensor for detecting the sheet stack 50, a second detecting sensor (second detecting unit) 74 for detection of the sheet stack 50 at upper area, and a third detecting sensor (third detecting unit) 75 for detection of the sheet stack 50 at the side are provided. Here, the third detecting sensor 75 is disposed, as illustrated in FIGS. 2A and 2B, in the lifting and lowering range.

In FIG. 2A, the uppermost surface 50*a* of the sheet stack 50 placed on the tray 61 abuts with the third detection sensor 75. In this state, state of detection by the third detecting sensor 75 is OFF. This state is referred to as replenishment position.

The state shown in FIG. 2B is such that the tray 61 moved up from the state shown in FIG. 2A and the uppermost surface 50*a* of the sheet stack 50 is detected by the second detecting sensor 74. In this state, side face of the sheet stack 50 supported on the tray 61 is detected by the third detection sensor 75 and the uppermost surface 50*a* of the sheet is detected by the second detecting sensor 74. In this state, sheet feeding operation to the image forming portion 901 is carried out.

Now, configuration of the third detecting sensor 75 will be described. As illustrated in FIG. 4, the third detecting sensor 75 has a sensor flag 75*a*. The sensor flag 75*a* rotates clockwise (on the drawing) by own weight thereof as long as it does not make contact with end of the sheet stack 50 and end of the tray 61. When the sensor flag 75*a* is present on this position P, a light from light emitting portion of a photo-interrupter 75*b* to light receiving portion is transmitted.

Meanwhile, when the sheet stack 50 or tray 61 makes contact with the sensor flag 75*a*, the sensor flag 75*a* rotates counterclockwise in the drawing. At this position Q, the sensor flag 75*a* blocks a light from light emitting portion of the photo-interrupter 75*b* to the light receiving portion.

This third detecting sensor 75 is used to lower the tray 61 at replenishment or replacement of sheets. By pressing a button (not shown) for the sake of replenishment of sheets, the tray 61 goes down from the position where feeding operation is performed (e.g., goes down from the position shown in FIG. 2B to the position shown in FIG. 2A), and the sensor flag 75*a* moves from the position Q to the position P. The control unit C then determines that the uppermost surface of the sheet stack 50 or tray 61 is now present at a position lower than the third detecting sensor 75. If the tray 61 stops in this instance, this becomes a replenishment position. Locking of a lock mechanism 69 is then released to draw the sheet accommodating portion 62 to execute replenishment or replacement of sheets. Meanwhile, the lock mechanism 69 is designed so that locking can not be released before the tray 61 moves to the replenishment position, and that locking is released automatically or by button manipulation after the tray 61 moved to the replenishment position.

There is no need for the tray 61 to be lowered down to the lowest limit position at the time of sheet replenishment if the tray 61 stops at the replenishment position where the uppermost surface of the sheet stack 50 or tray 61 abuts with the third detection sensor 75, as mentioned above. If height of the tray 61 is maintained at higher position in sheet replenishment state, compared to the case where the tray 61 is lowered down to the lowest limit position, a distance to the tray at the time of replenishment or sheet replacement becomes shorter. Therefore, ease of the sheet replenishment is improved.

(First Detecting Unit)

Next, the first detecting sensor (foreign object detecting sensor) 70 as the first detecting unit will be described. In the present embodiment, a method for detecting the foreign object 90 such as paper bag for spare sheets or surplus sheet stack will be described. FTC. 5 is a side elevation view describing details of the first detecting sensor 70.

As illustrated in FTC. 5, the first detecting sensor 70 includes a sensor flag 71 which makes contact with the foreign object 90 and the photo-interrupter 75*b*. The first detecting sensor 70 is disposed higher than the second detecting sensor 74.

Figure 5:
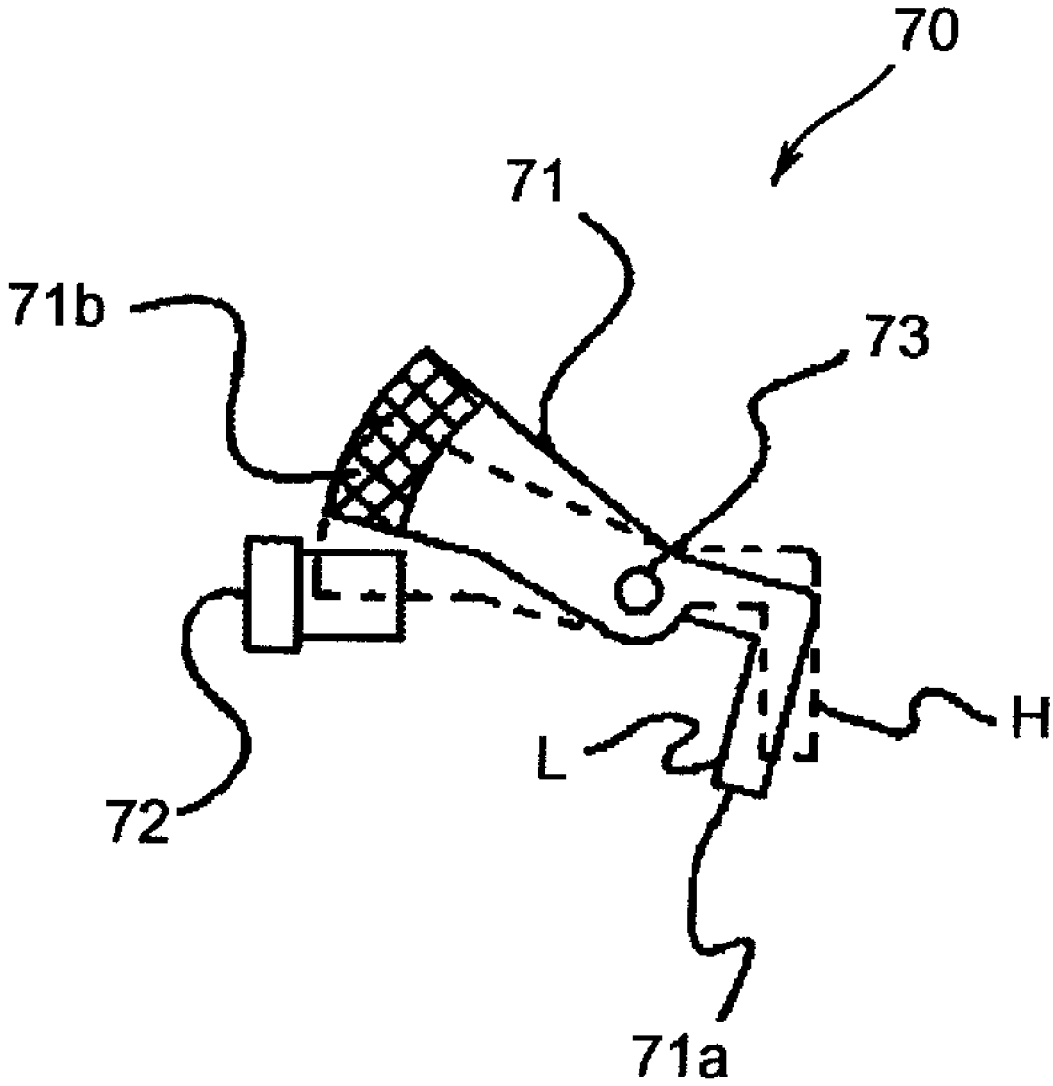
FIG. 5 is a side elevation view describing details of a foreign object detecting sensor.

The sensor flag 71 is held rotatably around a rotating shaft 73. In the state where papers do not abut, a front end 71*a* of the sensor flag 71 is in down state due to own weight thereof. In this way, the sensor flag 71 is in stand-by state being swung clockwise in FIG. 5 (position L in FIG. 5).

When the front end 71*a* of the sensor flag 71 of the first detecting sensor 70 makes contact with the foreign object, the front end 71*a* of the sensor flag 71 is pushed upwardly. The light shielding portion 71*b* of the sensor flag 71 then blocks a detection light between the light emitting portion of a photo-interrupter 72 and light receiving portion (position H in FIG. 5). With this configuration, the first detecting sensor 70 detects presence or absence of a foreign object.

Next, description will be given by exemplifying a state where the foreign object 90 is supported on the tray 61. FIG. 3A illustrates a state where the sheet stack 50 of smaller size such as A4 and LTR is supported at left side on the tray 61 of the paper deck 3000, and the foreign object 90 other than sheets such as papers to be fed is placed in an empty space generated at the right thereof.

Figure 3B:
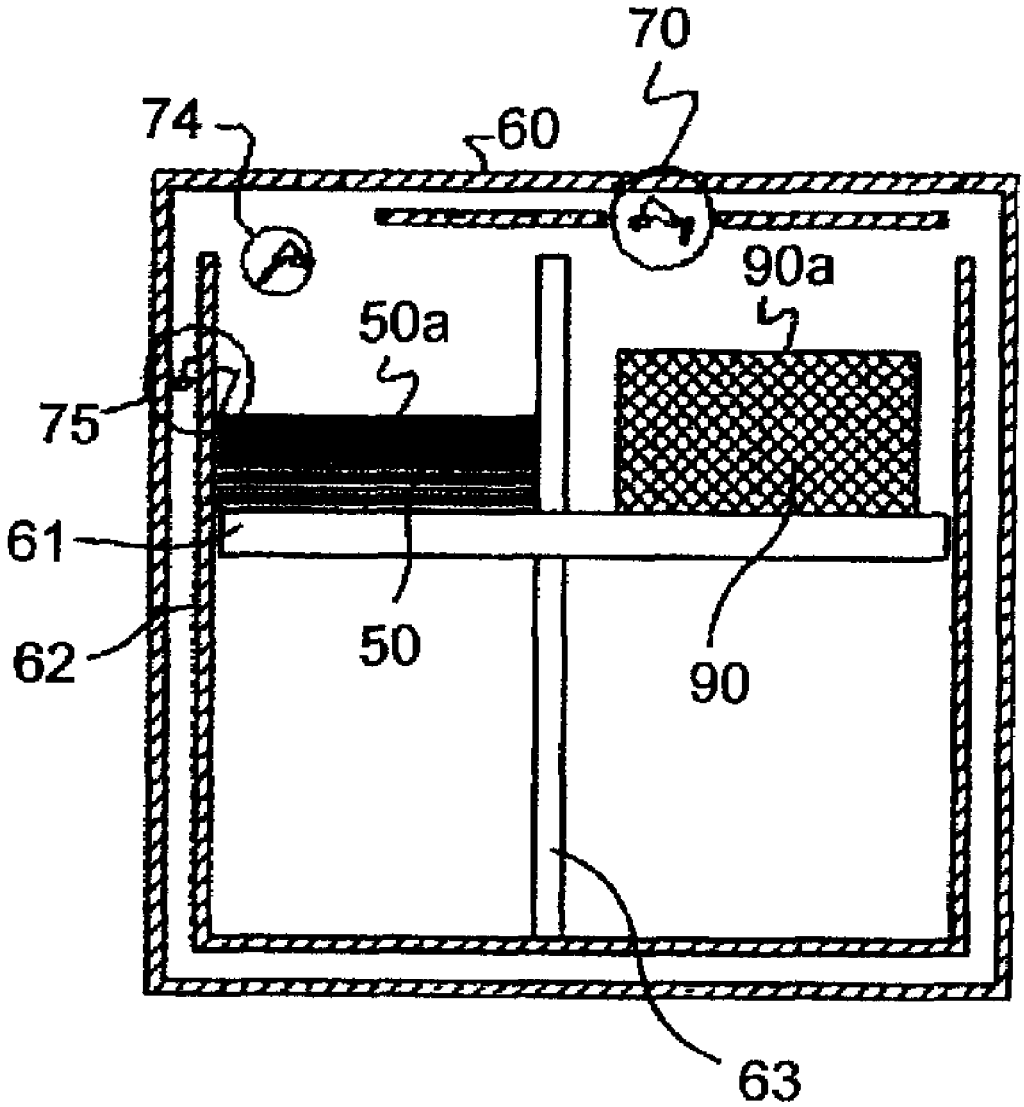
Figure 4:
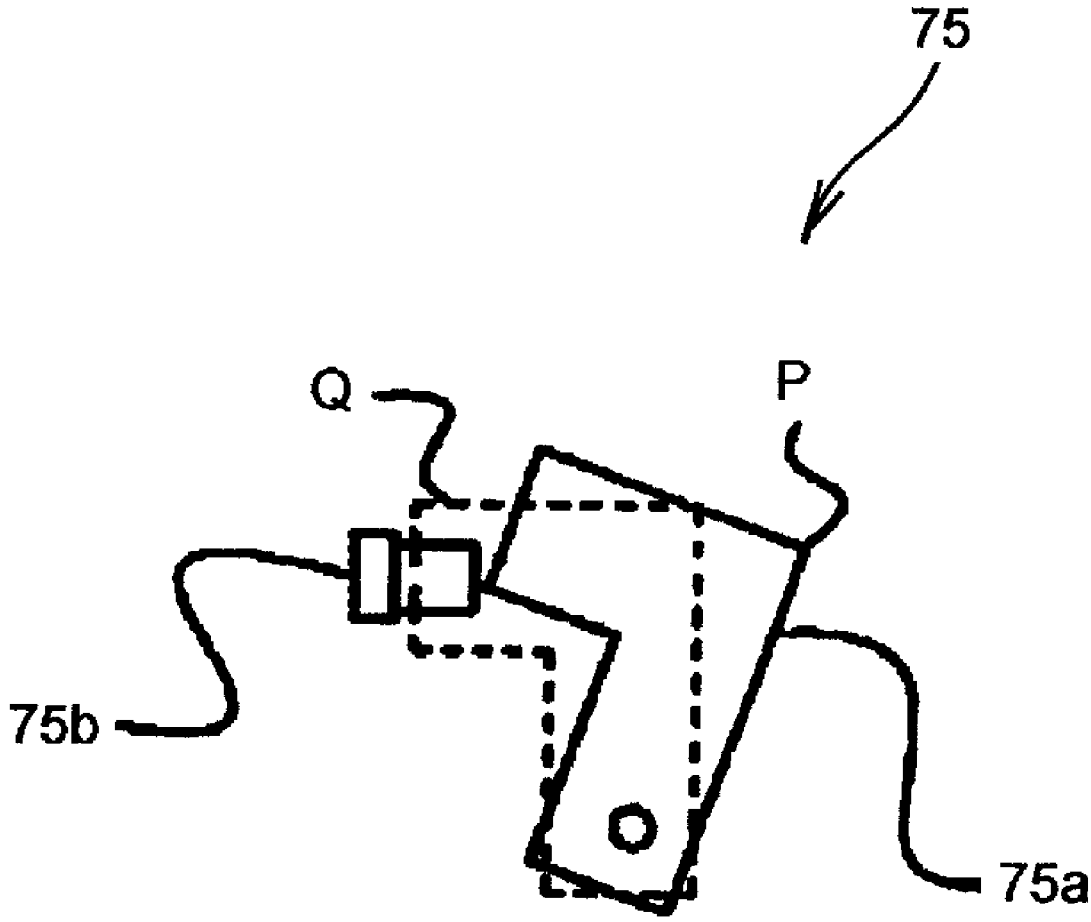
FIG. 4 is a side elevation view describing details of a third detecting sensor.

As illustrated in FIG. 3B, in a state where the sheet stack 50 is supported by the tray 61, there is such a case where height of the foreign object 90 is higher than that of the sheet stack 50. On this occasion, as the tray 61 goes up due to feeding of the sheet S to the image forming portion 901, the uppermost surface 90*a* of the foreign object 90 is detected by the first detecting sensor 70 before the uppermost surface 50*a* of the sheet is detected, as illustrated in FIG. 3A. And the control unit C detects the object on the tray 61, as that a height of the foreign object 90 is higher than height of the sheet stack 50 on the tray 60 is judged based on the detection of the foreign object detecting sensor 70 and second detecting sensor 74.

Figure 3C:
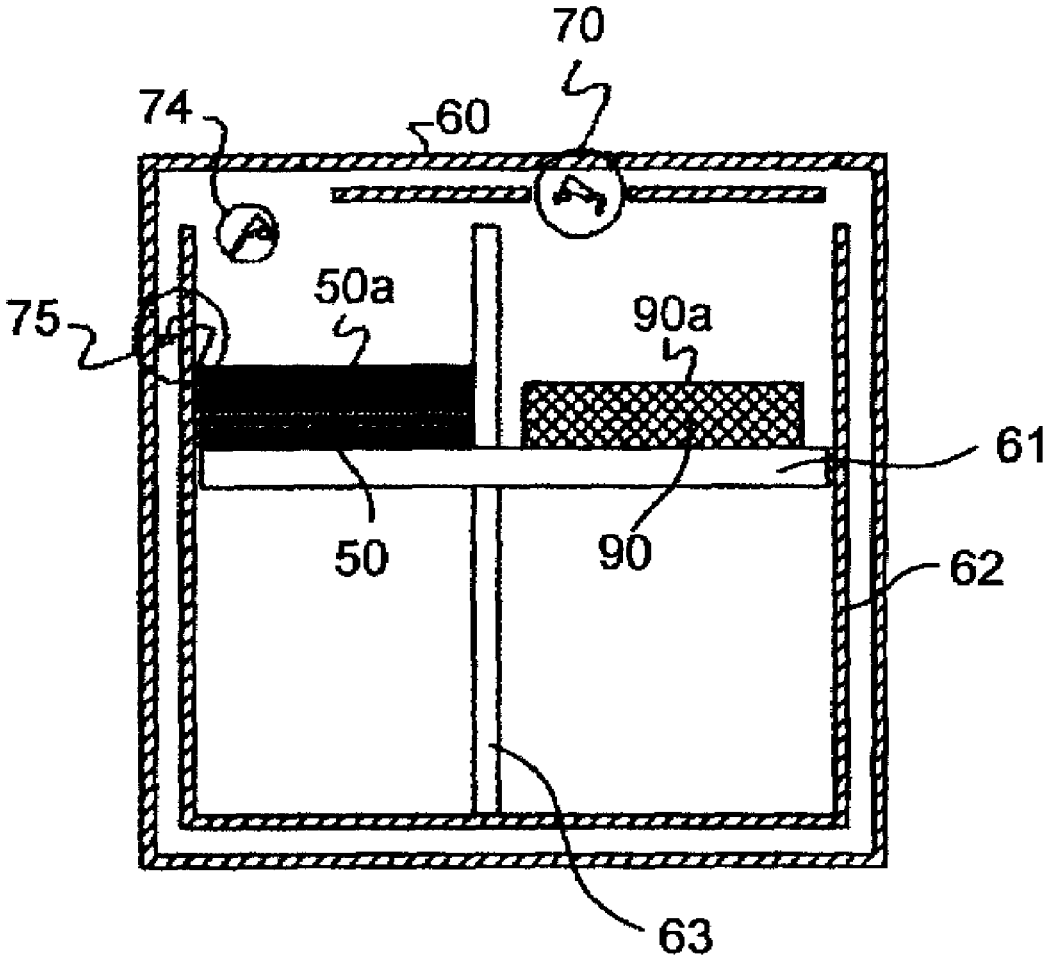

In the meantime, as illustrated in FIG. 3C, there is such a case where, in a state where the sheet stack 50 is supported by the tray 61, height of the foreign object 90 is lower than that of the sheet stack 50. On this occasion, as the tray 61 goes up the sheet S is fed to the image forming portion 901, the uppermost surface 50*a* of the sheet is detected by the second detecting sensor 74 before the uppermost surface 90*a* of the foreign object 90 is detected by the first detecting sensor 70.

If feeding operation is continued with this state, the uppermost surface 50*a* of the sheet goes down as the sheet S is fed. Accompanied by this, the control unit C then causes the tray 61 to go up in order to go up the uppermost surface 50*a* of the sheet stack 50. The uppermost surface 90*a* of the foreign object 90 also goes up and the foreign object 90 is eventually detected by the first detecting sensor 70.

In the present embodiment, when the foreign object 90 is detected by the first detecting sensor 70, the tray 61 is caused to go down to the replenishment position. While the tray 61 is in stand-by state at the replenishment position, the user executes foreign object removal operation. That the tray 61 goes down to the replenishment position is detected by the fact that the third detecting sensor 75 is turned OFF. A locking is provided by the lock mechanism 69 in such that the sheet accommodating portion 62 can not be drawn from the apparatus body 60 before the tray 61 is moved to the replenishment position. After the tray 61 is moved to the replenishment position, the locking is released automatically or by button manipulation.

(Control Block Diagram of Paper Deck)

Detection signals from the second detecting sensor 74, third detecting sensor 75, first detecting sensor 70 are input to the control unit C. Based on detection signals from each of sensors, feeding of the sheet is carried out by controlling the driving of the paper feeding unit, lifting and lowering of the tray 61 are carried out by controlling the driving of the lifting and lowering driving unit Df, and operations of the lock mechanism are controlled.

(Procedures of Foreign Object Detection Operation)

Figure 6:
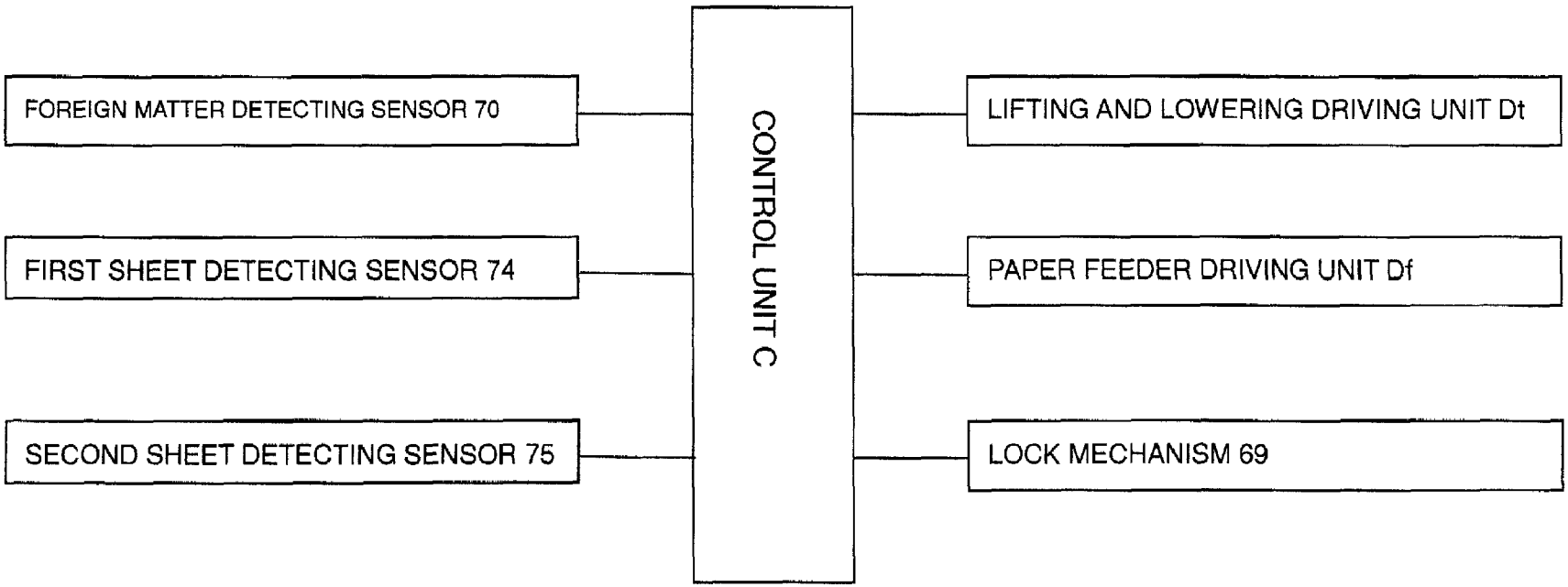
FIG. 6 is a control block diagram according to the present embodiment.

Referring to the flowchart illustrated in FIG. 6, a flow of feeding from the paper deck 3000 equipped with the first detecting sensor will be described. FIG. 6 is a flowchart showing control procedures of the present embodiment. Meanwhile S stands for step.

Upon setting the sheet accommodating portion 62 to the paper deck 3000 (S01), the tray 61 starts lifting (S02).

After the tray 61 goes up, at first, detection is carried out by either the second detecting sensor 74 or the first detecting sensor 70 (S03).

When detection is made first by the second detecting sensor 74, it is considered that the uppermost surface 50*a* of the sheet is detected (S04). Then, that position is recognized as the feeding position, thereby stopping the tray 61 (S05). In this way, the tray 61 stops and brought into stand-by state in preparation for feeding operation.

When feeding operation of the sheet S to the image forming portion 901 is initiated, the sheet S is supplied in the image forming portion 901 direction and therefore, the uppermost surface 50*a* of the sheet is lowered. When the tray 61 goes up by as much as lowering of the uppermost plate 50*a* of the sheet, height of the uppermost surface 50*a* of the sheet is maintained at the feeding position (S06).

As illustrated in FIGS. 2A and 2B, when no foreign object is placed on the tray 61, foreign object is not detected since the first detecting sensor 70 does not touch any foreign object (S07) Feeding operations are repeated as they are until the feeding job is completed (S08). In this case, eventually, the apparatus is in stand-by state waiting for the next job, while the uppermost surface 50*a* of the sheet is detected by the second detecting sensor 74.

Next, a case where the foreign object 90 is placed on the tray 61 will be described.

As illustrated in FIG. 3C, when the foreign object 90 having a height lower than that of the first sheet stack 50 is placed, as the tray 61 goes up after feeding operation is initiated (S06), the uppermost surface 90*a* of the foreign object 90 also goes up. The first detecting sensor 70 and the uppermost surface 90*a* of foreign object make contact, thereby detecting the foreign object 90 (S07).

Then, the control unit C stops feeding operation forcibly (S09) The tray 61 is then caused to go down to the replenishment position where detection by the third detecting sensor 75 is turned OFF (S11). After that, an error message notifying the user that there is the foreign object 90 on the tray is given to a user operation unit (S12).

In this case, if a sheet is being set to other feeding unit (e.g., sheet feeding apparatuses 1001 to 1004 of the body), the next feeding may be shifted to feeding from that unit. Besides, when no sheet is being set to any of feeding units, feeding may be stopped to remove the foreign object. Alternatively, feeding may be resumed when the same sheet is set to other feeding unit.

As illustrated in FIG. 3A or 3B, when the foreign object 90 is placed at a height higher than that of the first sheet stack 50, the foreign object 90 is detected by the first detecting sensor 70 before the uppermost surface 50*a* of the sheet is detected by the second detecting sensor 74 (S10). Therefore, the tray 61 is lowered down to the replenishment position at this point of time (S11), and an error message notifying that there is the foreign object on the tray is given to the user operation unit (S12).

Figure 7:
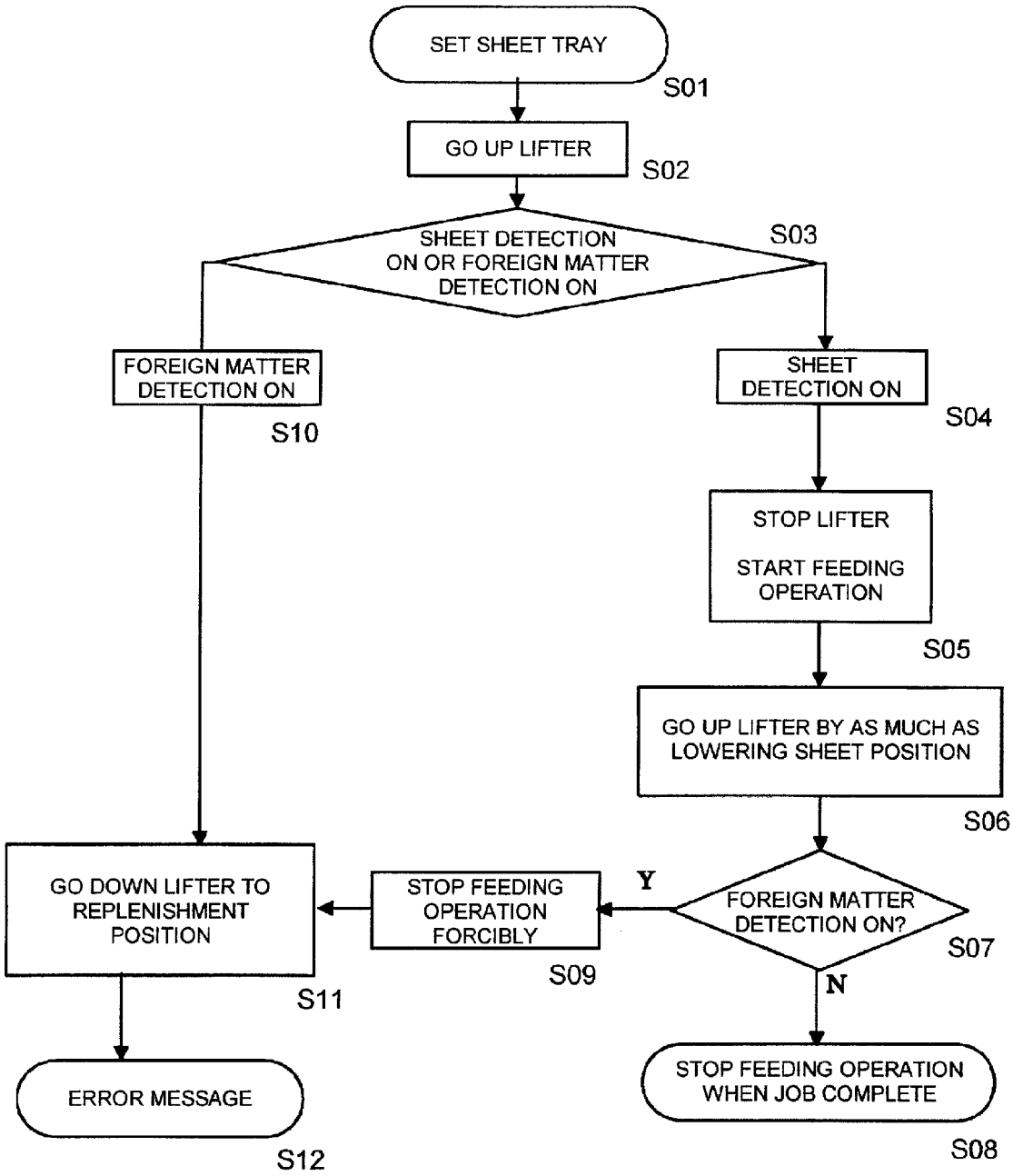
FIG. 7 is a flowchart describing control procedures of the present embodiment.
Figure 8:
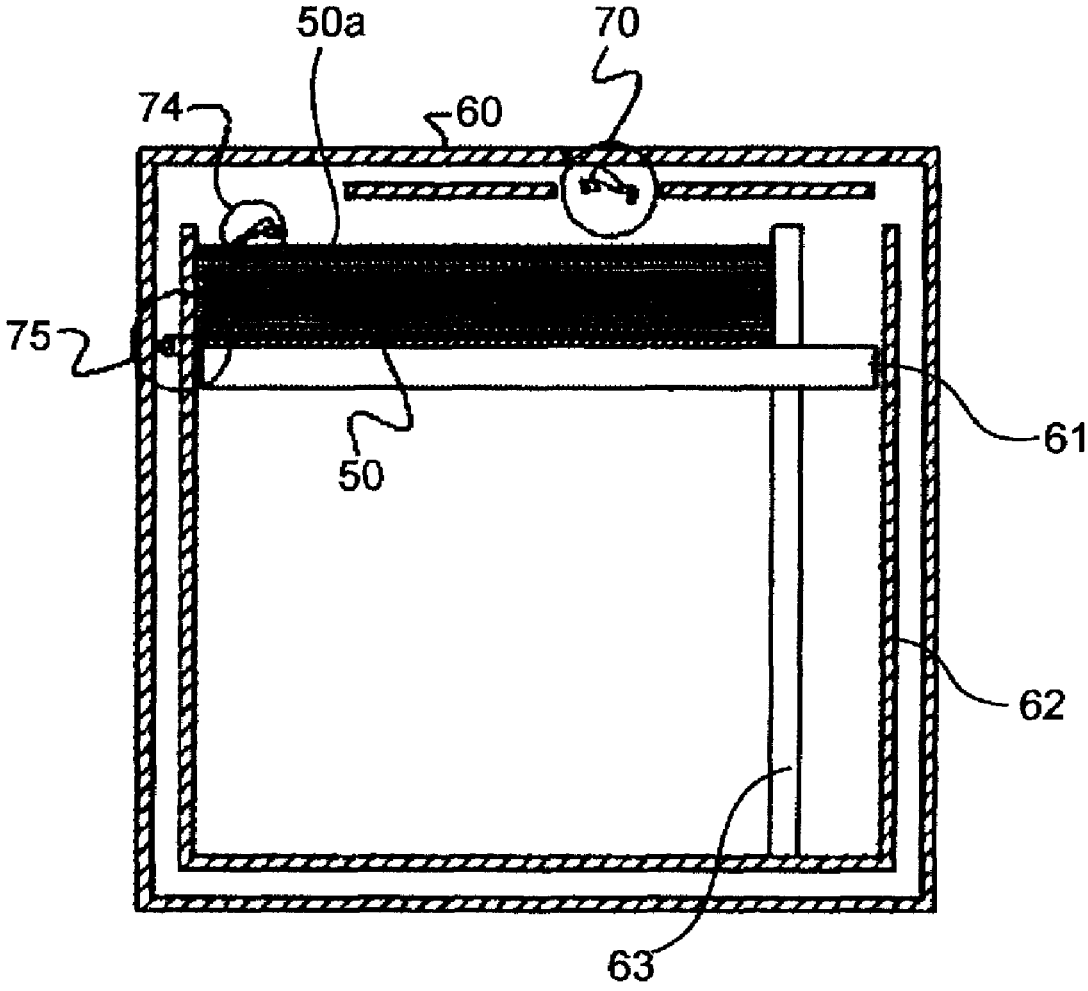
FIG. 8 is a view describing a case where large size sheets are supported by a sheet accommodating portion.
Figure 9A:
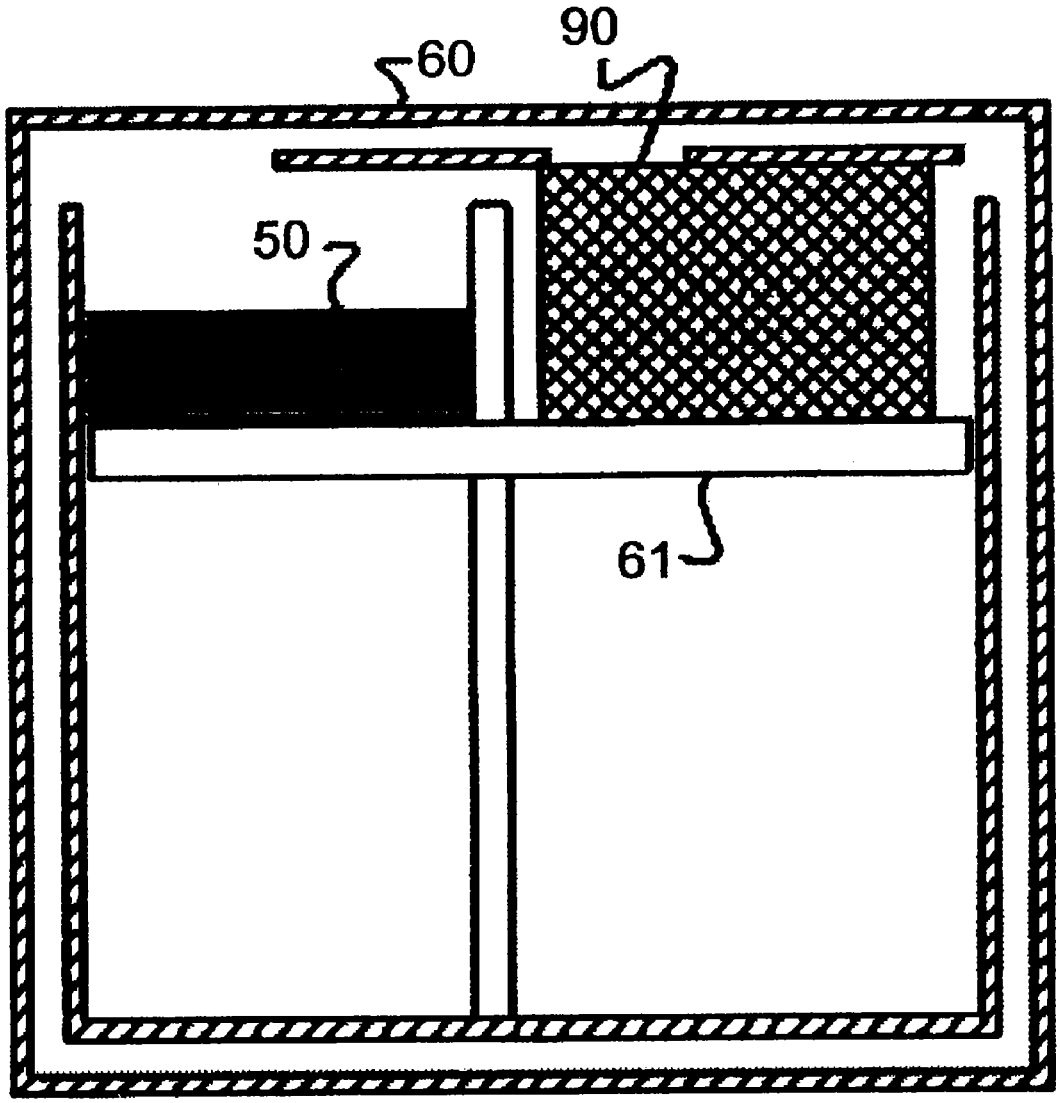
FIG.9A PRIOR ART
FIGS. 9A and 9B are views describing problems by the foreign object with conventional configuration.
Figure 9B:
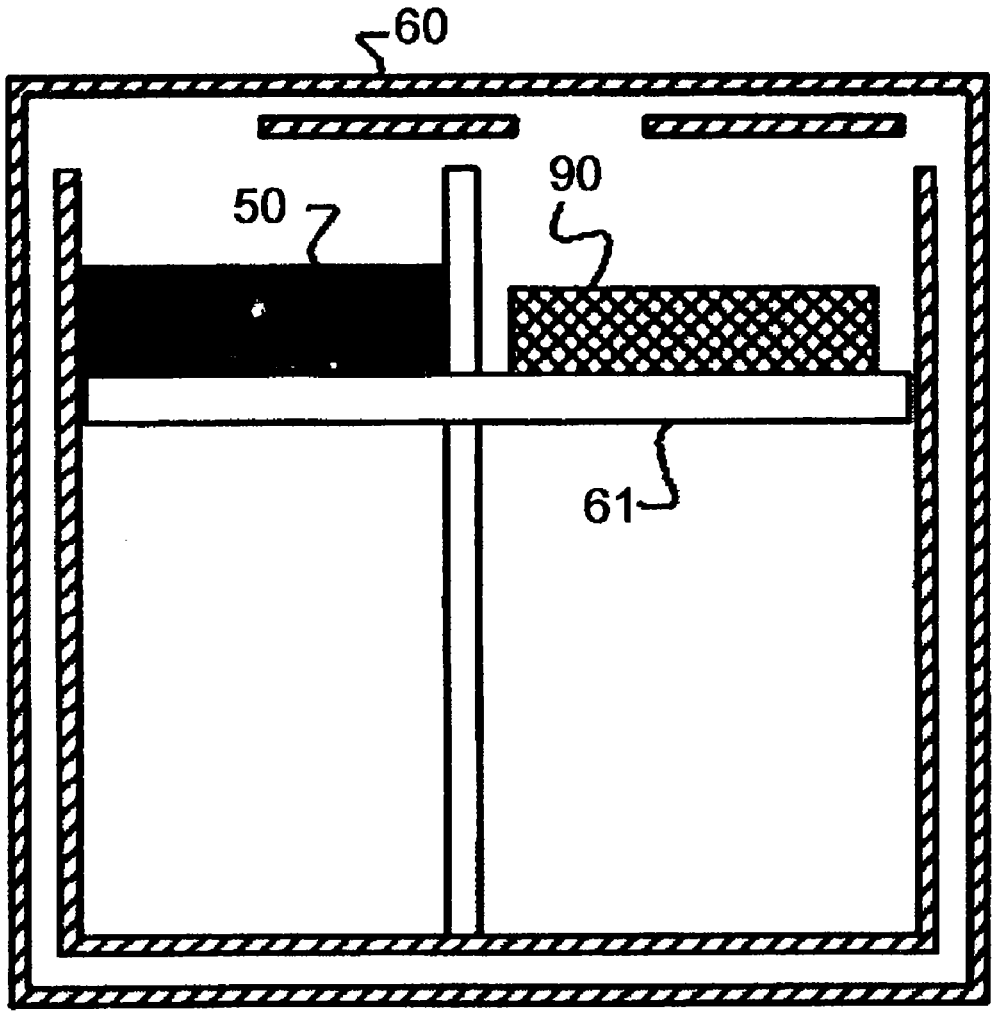
FIG.9B PRIOR ART

Next, a case where the sheet S of large size is supported will be described. FIG. 7 is a view illustrating a case where a large size sheet is supported by sheet accommodating portion 62.

As illustrated in FIG. 7, the sheet stack 50 is of large size, and the sheet stack 50 is present at the position of the first detecting sensor 70. When the sheet stack 50 of large size is to be placed, a sheet rear end regulating plate 63 is moved and the sheet stack 50 is placed on the tray 61.

When no foreign object is present, since the second detecting sensor 74 is disposed at the position lower than that of the first detecting sensor 70, the uppermost surface 50*a* of the sheet will be detected earlier by the second detecting sensor 74 than by the first detecting sensor 70.

Then, in the present embodiment, such a control is performed so that the uppermost surface 50*a* of the sheet may not go up exceeding the position of the second detecting sensor 74. Therefore, detection by the first detecting sensor 70 is not made, and there is no opportunity that a sheet S of large size is detected as the foreign object.

As described for the prior art, with such a configuration that presence or absence of a foreign object on a tray is detected depending on the size of sheet being set in advance and on the position of the hole for sensor flag detection, sensors are configured to detect an object immediately after it is placed on the tray. Therefore, certain discrimination is necessary that the sheet is to be determined as a foreign object or to be determined as normal sheet, depending on the size of the sheet stack being replenished. For this reason, it was necessary to alter controls for detection of a foreign object depending on the size.

In the present embodiment, since the first detecting sensor 70 is disposed at a height higher than that of the second detecting sensor 74, the uppermost surface 50*a* of the sheet does not go up exceeding the position detected by the second detecting sensor 74, as long as a normal sheet is placed. In this way, since detection by the first detecting sensor 70 is performed only when a foreign object is placed, there is no need for discrimination depending on the size. Accordingly, in the present embodiment, the composition used is to detect a foreign object regardless of the size of a sheet being placed. Therefore, it is possible to prevent erroneous determination based on detection by the first detecting sensor.

In the present embodiment, the first detecting sensor 70 is displaced at such a position which allows for detection of a paper bundle/paper pack of B-5 size, which is the minimum size capable of being replenished to the paper deck 3000, wherever it may be placed. Therefore, any sheet stack or spare paper pack remained can be detected certainly as the foreign object 90. Further, the first detecting sensor may be placed appropriately, supposing that a material other than paper bundle or paper pack, e.g., toner cartridge, is placed as a foreign object. Moreover, a plurality of first detecting sensors may be disposed.

Although, in the present embodiment, the first detecting sensor 70 is disposed to the paper deck 3000, which is connected to the copying machine, instead of to the copying machine, it may be disposed to the sheet feeding apparatuses 1001 to 1004 provided to the body.

This application claims the benefit of priority from the prior Japanese Patent Application No. 2006-102192 filed on Apr. 3, 2006 the entire contents of which are incorporated by reference herein.

What is claimed is:

1. A sheet feeding apparatus comprising:

a tray which is lifted and lowered with sheets in a sheet stack being supported;

a controller for lifting and lowering of the tray;

a sheet feeding member which feeds an uppermost sheet of the sheets on the tray at a feeding position;

a first detecting unit which detects an object placed on the tray other than the sheets to be fed by the sheet feeding member and communicates that detection to the controller; and a second detecting unit which detects an uppermost surface of the sheets on the tray, wherein the controller controls so that the tray is lifted based on a detection of the second detecting unit so that the uppermost sheet is lifted to the feeding position;

wherein a position of the first detecting unit for detection is above a position of the second detecting unit for detection, and wherein said controller controls lifting and lowering of the tray so that, as the tray is lifted, if the object is detected based on the detection of the first detecting unit before the uppermost sheet is detected based on the detection of the second detecting unit, the lifting of the tray is stopped.

2. The sheet feeding apparatus according to claim 1, wherein if the object on the tray is detected before the uppermost sheet is detected, a height of the object is higher than height of the sheet stack on the tray is judged based on the detection of the first detecting unit and second detecting unit.

3. The sheet feeding apparatus according to claim 1, further comprising a third detection unit which is disposed at lower part of the second detecting unit and in a lifting and lowering range of the tray, the third detecting unit detects the upper surface of the sheet stack on the tray, and the tray is caused to go down, based on detection of the first detecting unit, until the sheet stack on the tray is detected by the third detecting unit.

4. The sheet feeding apparatus according to claim 1, wherein the tray is caused to go down based on detection of the first detecting unit.

5. The sheet feeding apparatus according to claim 4, wherein a sheet accommodating portion having the tray is provided detachably attachable to and from an apparatus body;

a lock mechanism, which locks so that the sheet accommodating portion can not be drawn from the apparatus body, is provided; and the tray goes down based on a detection of the first detecting unit, and as the tray is stopped based on detection of the third detecting unit, the lock mechanism is made releasable.

6. An image forming apparatus comprising a sheet feeding apparatus and an image forming portion which forms an image on a sheet delivered from the sheet feeding apparatus, the sheet feeding apparatus comprising:

a tray which is lifted and lowered with sheets in a sheet stack being supported;

a controller for lifting and lowering of the tray;

a sheet feeding member which feeds an uppermost sheet of the sheets on the tray at a feeding position;

a first detecting unit which detects an object placed on the tray other than the sheets to be fed by the sheet feeding member and communicates that detection to the controller; and a second detecting unit which detects an uppermost surface of the sheets on the tray, wherein the controller controls so that the tray is lifted based on a detection of the second detecting unit so that the uppermost sheet is lifted to the feeding position;

wherein a position of the first detecting unit for detection is above a position of the second detecting unit for detection, wherein said controller controls lifting and lowering of the tray so that, as the tray is lifted, if the object is detected based on the detection of the first detecting unit before the uppermost sheet is detected based on the detection of the second detecting unit, the lifting of the tray is stopped.

7. The sheet feeding apparatus according to claim 6, wherein if the object on the tray is detected before the uppermost sheet is detected, a height of the object is higher than height of the sheet stack on the tray is judged based on the detection of the first detecting unit and second detecting unit.

8. The sheet feeding apparatus according to claim 6, further comprising a third detection unit which is disposed at lower part of the second detecting unit and in a lifting and lowering range of the tray, the third detecting unit detects the upper surface of the sheet stack on the tray, and the tray is caused to go down, based on detection of the first detecting unit, until the sheet stack on the tray is detected by the third detecting unit.

9. The sheet feeding apparatus according to claim 6, wherein the tray is caused to go down based on detection of the first detecting unit.

10. The sheet feeding apparatus according to claim 9, wherein a sheet accommodating portion having the tray is provided detachably attachable to and from an apparatus body;

a lock mechanism, which locks so that the sheet accommodating portion can not be drawn from the apparatus body, is provided; and the tray goes down based on a detection of the first detecting unit, and as the tray is stopped based on detection of the third detecting unit, the lock mechanism is made releasable.

* * * * *